United States Patent [19]

Godlewski

[11] Patent Number: 4,715,593

[45] Date of Patent: Dec. 29, 1987

[54] STACK-SUPPORTING BOTTOM FEED CONVEYOR

[76] Inventor: Edward S. Godlewski, 129 S. Spruce St., Wooddale, Ill. 60691

[21] Appl. No.: 7,577

[22] Filed: Jan. 28, 1987

Related U.S. Application Data

[63] Continuation of Ser. No. 803,249, Dec. 2, 1985, abandoned.

[51] Int. Cl.[4] ..... B65H 3/32

[52] U.S. Cl. ..... 271/10; 271/23; 271/35; 271/118; 271/119; 271/165

[58] Field of Search ..... 271/10, 23, 35, 37, 271/117, 118, 119, 125, 146, 165, 134

[56] References Cited

U.S. PATENT DOCUMENTS 3,506,258 4/1970 Lindquist ..... 271/119
3,933,350 1/1976 Mignano ..... 271/37 X
3,937,455 2/1976 Hauser ..... 271/119 X
4,437,656 3/1984 Onoda et al. ..... 271/119 X

*Primary Examiner*—Douglas C. Butler
*Attorney, Agent, or Firm*—John J. Kowalik

[57] ABSTRACT

A conveyor for removing stock items from the bottom of a stack comprising an intermittently operable roller member having conveying and lifting portions movable in an orbit, the conveying portions being operative during their operative periods to drag against the lowermost item of the stack seated thereon and enter one end of the item into a metering device which is operative during the same intervals to enter the leading end of each article into a pair of pullout rollers, the roller member cycling to dispose the lifting portions in lifting positions to the stack and providing smooth surfaced areas releasing the partially withdrawn items from under the stack during this interval.

20 Claims, 9 Drawing Figures

STACK-SUPPORTING BOTTOM FEED CONVEYOR

This is a continuation of application Ser. No. 803,249, filed Dec. 2, 1985, now abandoned.

BACKGROUND OF THE INVENTION

This invention pertains to bottom feed conveyors wherein stock intems, such as sheets of paper or envelopes and the like are arranged in a stack and the items are peeled off from the bottom of the stack. The only way heretofore to feed from the bottom of a stack was to lay the items imbricately on a long conveyor and arrange the items that only a very small number were piled one upon the other at the metering mechanism. Otherwise any attempts to increase the height of the pile at the metering mechanism resulted either in misfeeds or double or multiple feeds. Thus the conveyor had to be extensive and required various controls to insure proper feed rate so that the items would not bunch up at the metering mechanism. Ordinarily an operator was required to constantly shift and arrange the items so that they progressed in a uniform shingle-like arrangement toward the metering device.

SUMMARY OF THE INVENTION

The invention is directed to a bottom stack feeder wherein the stack is alternately lifted in toto to a position disposing the items out of reach of the metering device, while the bottom item is fed through the metering device and has its leading end in a pullout mechanism so that it is entirely pulled out prior to the stack being lowered and the next bottom piece is disposed to feed into the metering device. The lifting mechanism engages the bottom of the stack with a lifting ramp which is made of material having a low coefficient of friction so that the trailing end of the bottom item being pulled out from under the stack is easily withdrawn by the pullout mechanism individually.

The invention comprehends a feeding mechanism comprising a conveying section and a lifting section which are periodically juxtaposed with reference to a stack of items to be conveyed from the bottom to lift and lower the stack in a predetermined sequence disposing the lowermost item on and off the conveying section and so arranging these sections so that they facilitate removal of the bottom item from the stack.

A general object of the inventions is to provide a novel conveying system for bottom feeding from a stack of items, said system operative to lower the stack onto a conveyor portion which begins to strip an item from the bottom of the stack and positions it to a metering device for individual withdrawal and to a further pullout device whereupon the stock is lifted by a slidable lifter which allows the remainder of the bottom item to be completely withdrawn by the pullout device while the higher up items are held out of reach of the metering device.

A more specific object is to provide a conveyor having a roller assembly driven to rotate half turns and having circumferentially spaced agressive forwarding, advancing or conveying sections and intervening radially outwardly projecting ramp or lift sections with nonagressive smooth surfaces adapted to lift the stack and providing slide areas for easy removal of an item at the bottom of the stack engaged thereby.

The invention comprehends providing a metering device having a retard cylinder and an opposing lower feed roller defining an intake nip for grasping stock items delivered thereto by a conveyor from the bottom of a stack, the feed roller having a longer traverse than the conveyor so as to completely withdraw the item from under the stack before the conveyor is conditioned to convey the next suceeding item from the bottom.

Another object of the invention is to provide a stack-holding chute with a bottom discharge for depositing the stock upon a conveying mechanism having a stack lifters. The chute provides a discharge passage adjacent to its lower enddirected toward a metering unit which includes a pair of pendulously suspended fanning wheels and an intervening retard cylinder adjustable toward and away with respect to a feed wheel which is positioned beneath the retard cylinder to define a metering nip therewith. The retard cylinder is positioned atwarth the delivery direction of stock items which are delivered in a batchs from the lower portion of the stack by a conveying mechanism against the fanning wheels and the cylindrical profile of the retard cylinder. The fanning wheels and profile of the retard also assist in positioning the lowermost stack item within the nip whereby upon actuation of a primary conveyor component, which moves the lowermost item through the nip and into a pullout assembly. The conveyor, thereafter lifts the stack to facilitate removal of the lowermost item by the pullout assembly.

These and other objects and advantages inherent in and encompassed by the invention will become more apparent from the specification and the drawings, wherein.

Figure 1:
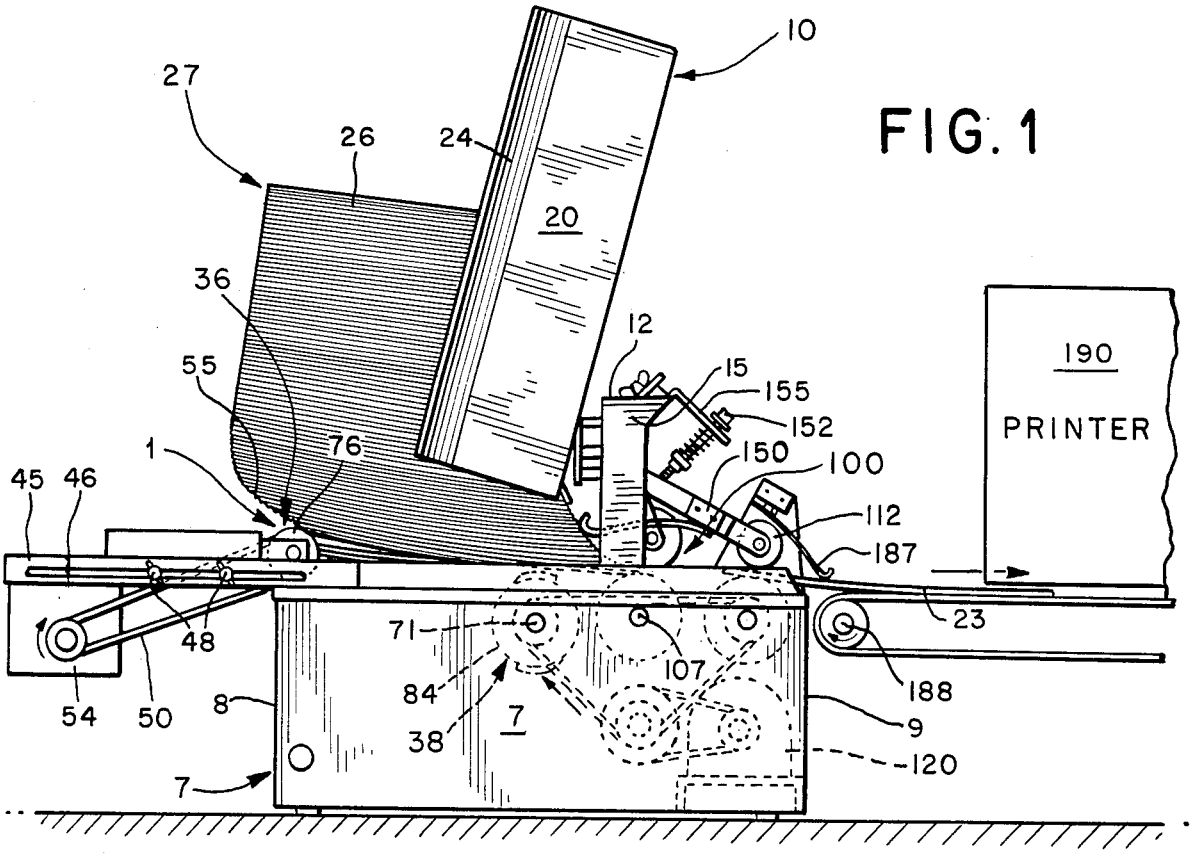
FIG. 1 is a side elevational view of the novel conveyor shown in association with a printer.
Figure 4:
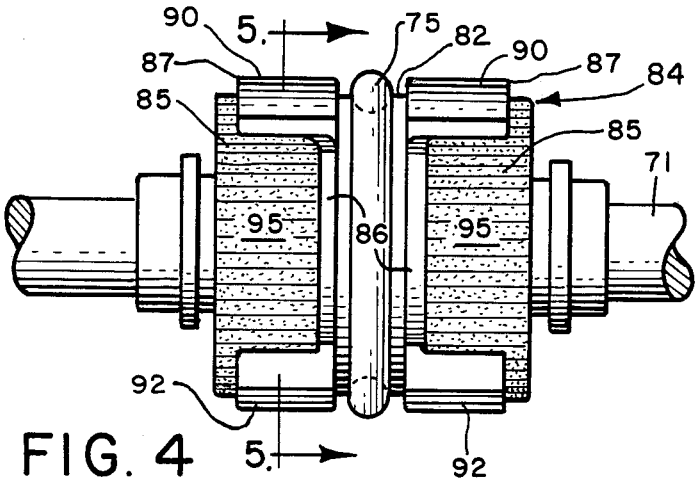
Figure 5:
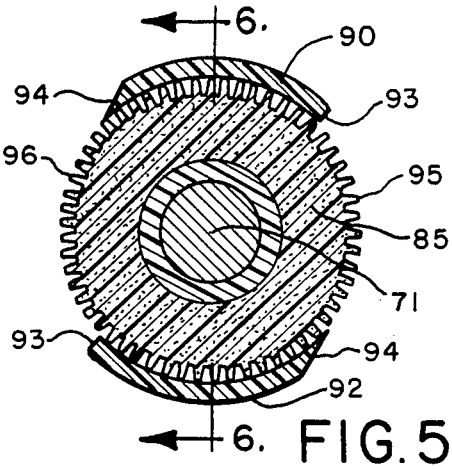
Figure 6:
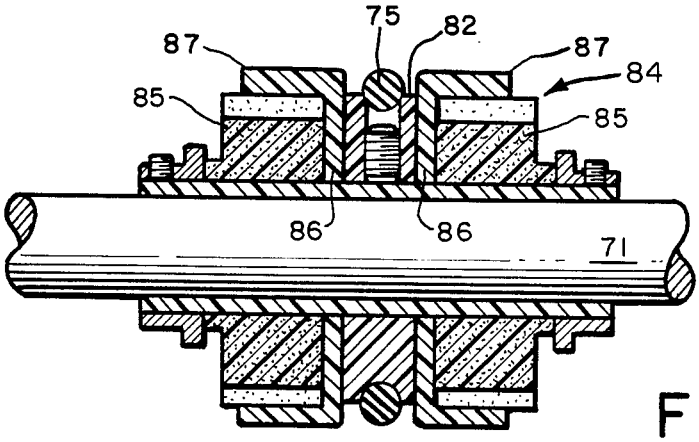
Figure 2:
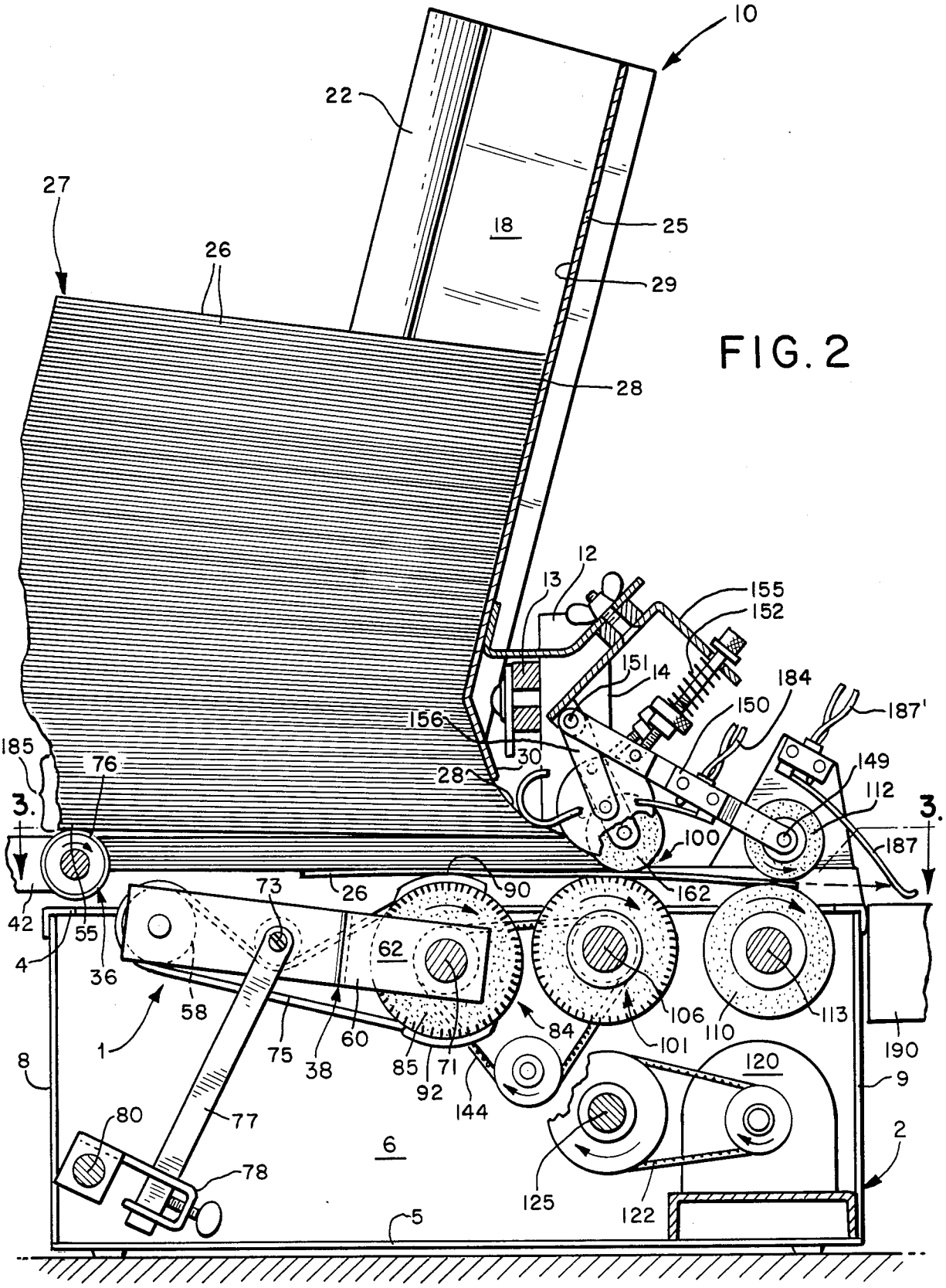
FIG. 2 is a longitudinal vertical sectional view thereof.
Figure 2A:
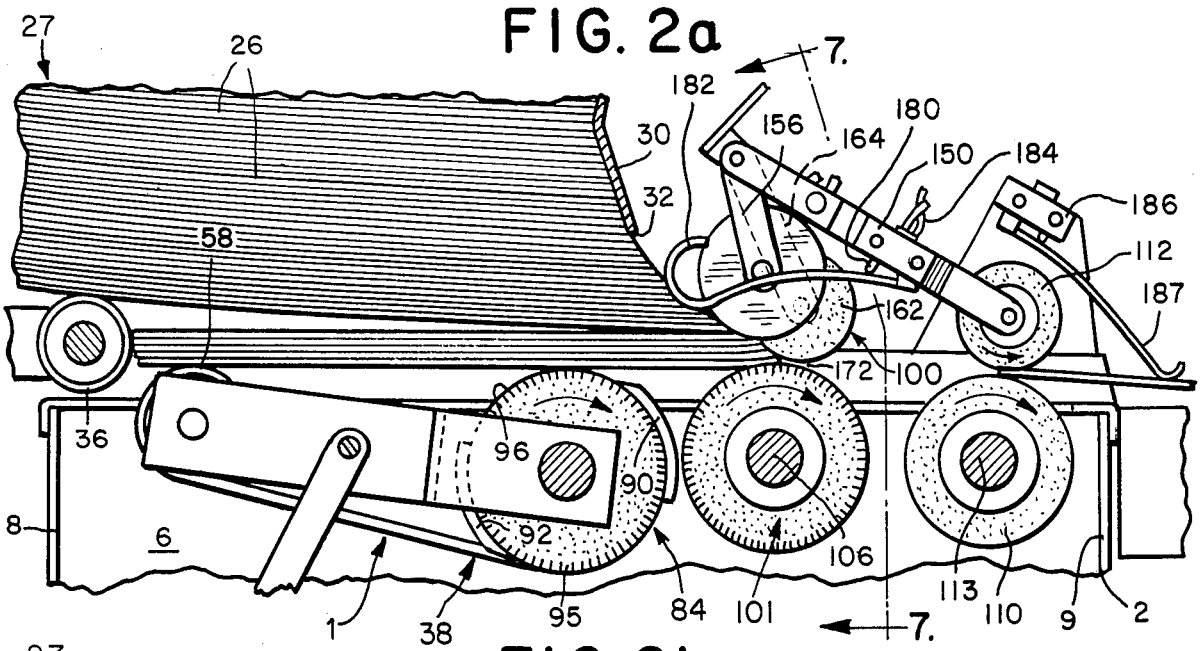
Figure 2B:
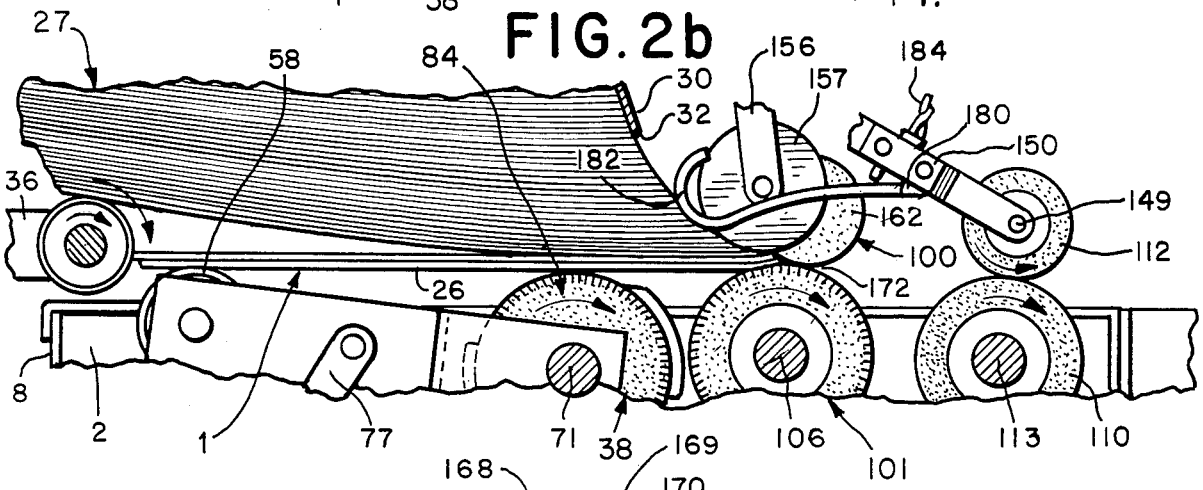
Figure 7:
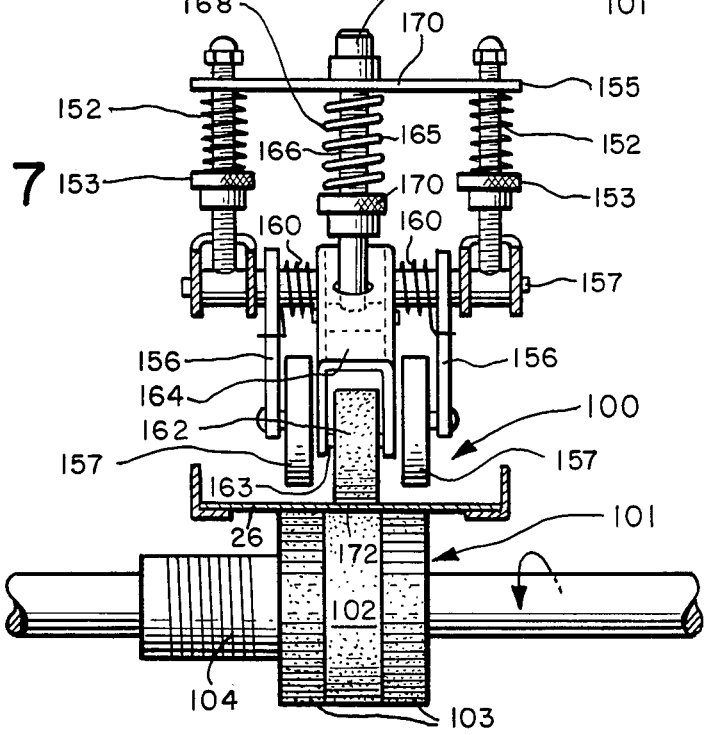
Figure 3:
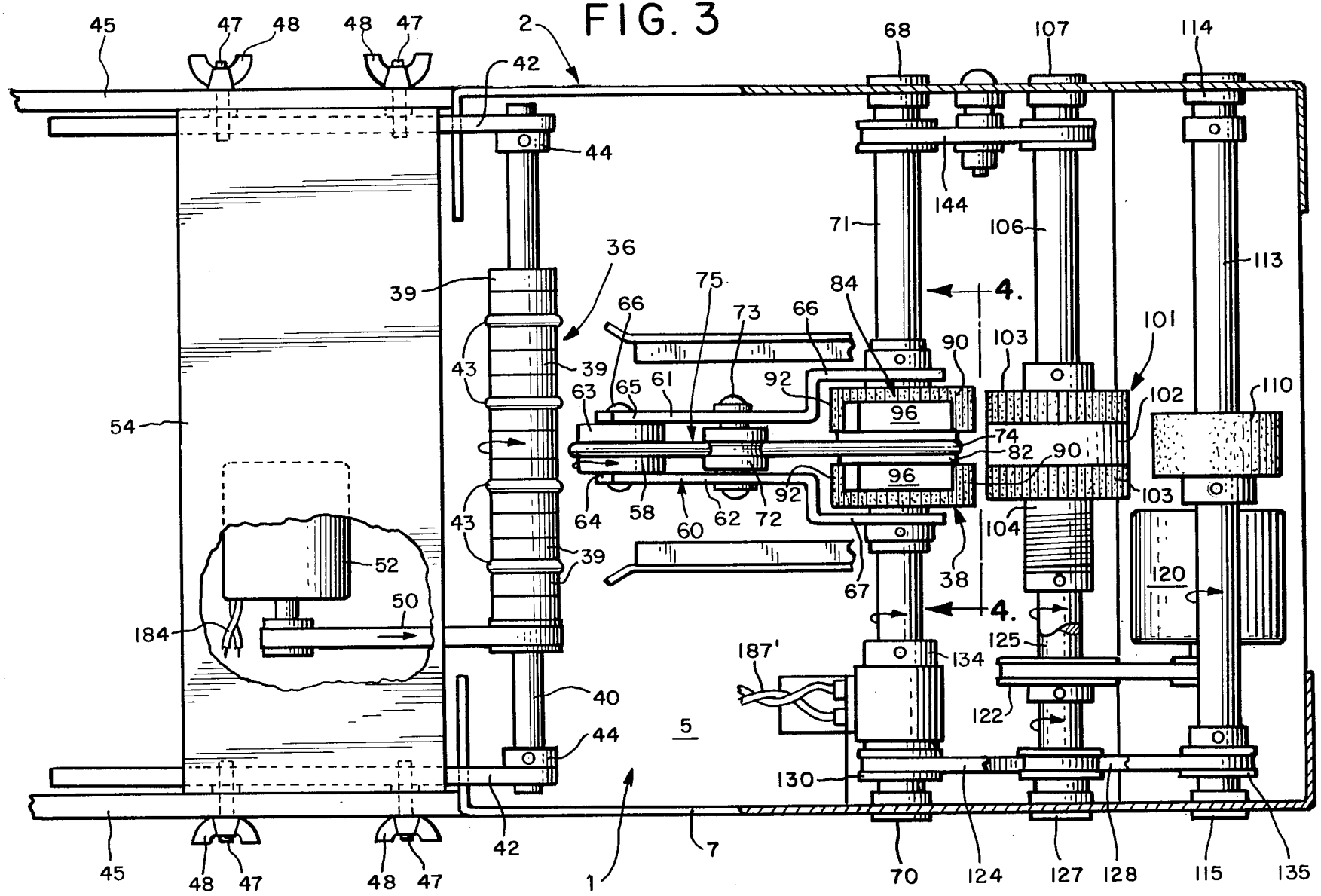

FIGS. 2*a* and 2*b* are more detailed views of portions of FIG. 2;

FIG. 3 is a horizontal sectional view; FIG. 4 is an enlarged cross-section taken substantially on line 4—4 of FIG. 3;

FIG. 5 is a cross-section take substantially on line 5—5 of FIG. 4;

FIG. 6 is an axial section take substantially on line 6—6 of FIG. 5; FIG. 7 is an enlarged cross-section taken essentially on line 7—7 of FIG. 2*a*.

DESCRIPTION OF THE INVENTION

The conveying system 1 illustrated in the drawings comprises a base support providing a box-like enclosure which has top and bottom walls 4 and 5, side walls 6,7, and end walls 8 and 9.

A chute or magazine 10 is carried above the support by means of a frame structure which comprises a cross-bar 13 and stand-off legs 14,15 at opposite ends mounted at their lower ends on the top wall 4 of the support adjacent the side walls 6 and 7.

The chute is U-shaped in horizontal section and has a pair of upright side walls 22,24 defining an open rear side of the chute flanked by laterally flaring flanges and having a diagonal front panel 25 sloping downwardly and rearwardly. The rear flanges 22,24 being angled away from each other facilitate entry of stock items 26,26 which are piled in a vertical stack within the chute and have their leading edges 28 slidably engaging the back or interior side 29 of the front panel and their lateral edges engaging the flanking side wall of the chute which may be laterally adjustable.

A lower portion 30 of the front panel is angled forwardly and with its lower edge defines a passageway for the items with a novel conveying mechanism spaced therebelow and carried from the support as hereinafter described.

The conveying mechanism comprises a rear conveyor section 36 and a front conveyor section 38.

The rear conveyor section comprises a cylindrical roller body made up of a series of disks 39, 39 which are sleeved onto and secured to a mounting drive shaft 40 positioned horizontally between a pair of support arms 42,42 and journalled in bearings 44,44 thereon. The disks are made of elastomer material such as polyurethane or the like of medium softness and some of the disks are peripherally ribbed and others may be provided with grooves mounting rubber-like rings 43 of cylindrical cross-section. The arms 42 may extend rearwardly from the support alongside a pair of flanking support guide bars 45,45 which may have elongated slots 46 therein for receiving mounting bolts therethrough, said bolts 47 being connected to the arms 42 at their inner ends and having wing nuts 48 threaded on the outer ends for engagement with the external sides of the support bars as seen in FIG. 3. Thus the rear conveyor section is adjustable with respect to the front conveyor section to accommodate stock items of different lengths.

The rear conveyor section 36 is driven by a belt and pulley drive 50 from an electric motor 52 suitably carried on a supporting enclosure 54 mounted on the support bars 45. As best seen in FIG. 2 b the rear conveyor section 36 is underposed with respect to the trailing end portions 55 of the stock items.

As best seen in FIG. 2, 2*a* and 2*b* the stock items 26 extend over the forward or front conveyor section 38 which comprises front and rear roller assembles best seen in FIG. 2, 2*a*, 2*b* and 3 and identified 85,58.

The rear assembly 58 comprises a frame 60 including a pair of laterally spaced side members 61,62 and a grooved pulley 63 mounted between the rear ends 64,65 thereof on a rivet 66 secured to the side frames and rotatable on a horizontal axis. The forward ends of the frames are mounted pivotally via bearings as at 66, 67 on a horizontal drive shaft 71 which is mounted on bearings 68,70 from the side panels of the support.

The side frames 61,62 mount intermediate their ends a take-up or tightened pulley 72 on a rivet 73, the pulley 72 running over the top run 74 of a driver conveyor belt 75 which is also trained about the rear pulley 63 and projects radially outwardly therefrom in contact with the bottom side 76 of the lowermost item 26 26 as best seen in FIGS. 2*a* and 2*b*. The frame is vertically adjustable by a standard 77 which at its upper end is pivoted on the rivet 73 and at its lower end is releasably connected by a thumb screw to a bracket 78 which is pivoted on a horizontal bar carried by the side walls, 6,7 of the support.

The forward end of the endless elastomeric or rubber belt 75 is trained about a center pulley section 82 of a combined conveying and lifting and lowering roller assembly generally designated 84 of the forward component 38. The roller assembly 84 also comprises a pair of elastomeric ribbed wheels 85,85 embracing the pulley 82 and affixed therewith and with a pair of outer hubs 86,86 of lifters 87,87 to shaft 71. The hubs are formed at their outer peripheries with ramps or humps 90,92 at diametrically opposite sides. Each ramp axially overlaps a portion of the adjacent wheel and extends in this design preferably forty five radians along the circumference of the wheel and has a blunt leading end 93 and a sloping trailing end 94. The ramp 90 or lifter at one side is axially aligned with lifter 90 on the opposite side, and similarly, lifter 92 at one side is axially aligned with the lifter 92 at the opposite side. The ramps 90,92 are offset one hundred and eighty degrees from each other. The intervening peripheral portions 95,96 of each wheel 85 is ribbed. The elastomeric wheels are made of polyeurathane or like plastic material and the ramps or lifters 90,92 are slick and smooth and are made of Delrin or like plastic and are not agressive as are the portions 95,96.

The forward conveyor component leads into the retard or metering mechanism 100 which comprises a lower feed roller assembly comprised of a center smooth faced disk 102 and a pair or flanking peripherally ribbed wheels 103,103 all fastened to an overrunning clutch component 104 which permits the roller 101 to overrun the horizontal shaft 106 upon which it is mounted, shaft 106 being journalled at its ends in bearings 107 mounted on the side walls 6,7 of the support.

The feed roller 101 transfers the items to a pair of continuously rotating pullout rollers 110,112. The lower roller 110 is fastened to a horizontal drive shaft 113 which is journaled in bearings 114,115 at its ends on side walls 6,7 of the support.

A motor 120 is mounted on the bottom wall 5 and through a chain and sprocket drive 122 drives a horizontal countershaft 125 carried in bearing 127 from the side wall 6,7 of the support. The countershaft 125 drives a sprocket and chain assembly 128 which drives a half revolution clutch component 130 rotatably mounted on shaft 71 which is connected to the roller assembly 84 via the other component of the half revolution clutch 134. The drive 122 also drives shaft 113.

The shaft 71 transfers drive through a chain and sprocket driving train 144 to shaft 106 of the feed roller assembly of the metering mechanism.

It will be noted that the drive 144 is such that for each one half revolution of the assembly 84, the feed roller will rotate more than one revolution or than one third more under power so that it will travel perimetrically a greater distance than roller 84 in the same interval to insure delivery of the leading end of the metered item into the pullout rollers 110,112, the latter being carried on a rivet or pin 149 on the distal end of arm 150, which is pivoted at its other end on a rod 151 mounted on frame 12.

The arm 150 is spring biased downwardly by a spring assembly 152 reacting between adjuster 153 connected to arm 150 and an overhanging leg 155 of the frame 12.

The frame 12 pendulously carries on rod 151 arms 156,156, which at their lower ends mount a pair of freely rotatable fanning wheels 157,157 on axes parallel to shaft 113. The wheels 157 are each lightly spring biased into engagement with the leading ends of the stock items 26 being urged thereagainst and against the stack-facing side of the cylindrical retard 162, which is mounted on a horizontal axis parallel with the shaft 103 by a securing bolt 163 on the lower end of an arm 164 pivoted at its upper end on rod 151. The arm 164 is spring-biased downwardly by a spring assembly 165 having an adjusting screw shank 166 pivotally connected at its lower end to the arm 164 intermediate its ends and at its upper end passing through the leg 155 of the bracket 12. An adjusting screw 169 is threaded on the upper end of screw shank 166 and abuts against the top of leg 155 limiting expansion of biasing spring 168 sleeved on the shank 166 and compressed between a base nut 170 and the underside of the leg 155. Thus the gap 172 between the stationary retard cylinder 162 and the pullout wheel assembly therebelow (FIG. 2*b*) can be adjusted to slightly less that the thickness of the material passing therethrough.

In operation, the magazine is loaded with a stack of stock items 26 such as sheets of paper or envelopes (stuffed or empty). The rear or trailing ends portions 55 of the stack rest upon the conveyor roller 36 and the intermediate portion rests upon section 38, including the roller assembly 84.

A switch 180 is mounted on the frame 12 and has an arm 182 extending toward the leading edges 28 of the stack for contact therewith as shown. The switch 180 is connected by wires through any well known circuit to motor 52. When the portion of the stock which lifts the arm 182 is depleted, the arm 182 falls and closes the switch 180 causing the circuit to close and run the motor 52 and drive the roller 36 which delivers a batch of items 185 at the bottom of the stack through the passage below the edge 32 of the front panel of the chute over the lifter roller 84 and against the retard member 162 and the fanning wheels while coincidentally lifting the arm 182 and opening switch 180 thus stopping the roller; however some of the items 26 will drop at their trailing ends onto the drive belt portion 75 carried by the roller 58.

A support mounted switch 186 is positioned on the exit side of the rollers 110, 112 and has an arm 187 disposed in the delivery path of itens 26 as they move from from the pullout rollers toward the intake mechanism 188 of the press 190. The switch 186 is connected by wires 187' through an appropriate circuit as well known to the clutch 130,134 such that when the arm 187 drops sensing the absence of an article in the delivery path toward the press the electric clutch 130,134 is actuated causing the shaft 71 to turn one half revolution which causes the stack to slide off the ramps 90 and be lowered so that the bottom item is engaged and driven by the conveying sections 95,95 as seen in FIG. 2*b*. The rotation of the assembly 84 continues until the load is again lifted by the ramps 92 sliding under the bottom item which in the meantime has been advanced through the nip 172 of the retard and into the continuously running pullout rollers 110,112 as seen in the drawings.

Inasmuch as the ramps are smoothed surfaced the pullout rollers have no difficulty pulling the remainder of the bottom item 126 from under the stack as seen in FIG. 2. However, just prior to the arrival of item 26 under arm 187, in the interval shown in FIG. 2, the aram 187 had dropped and signalled for half turn of shaft 81 and conveyor 38 including assembly 84. Before the signal is completed the previous item is removed and the next item 26 is then positioned as seen in FIG. 2.

The lifting and lowering of the stack on and off the nonagressive and agressive sections of the assembly 84 functions to at least partially slide the bottom item from under the stack and as best seen in FIG. 2 lifting positions the leading ends of succeeding items against the retard cylinder 162 out of the nip 172 and thus insures against a double or multiple feed through the nip.

Inasmuch as the roller 101 rotates more than half revolution and obtains a firm purchase against the lowermost item it functions to eject it after the assembly 84 stops. As soon as the pullout rollers get hold, the stopping of drive to roller 101 obtains an overruning action and does not inhibit the pullout rollers from extracting the entire item.

It has been found with this equipment, that stacks weighing up to about seven pounds will feed properly at rates of thousands of items per hour. With previous systems only a few items could be stacked one upon the other, usually no more than twenty. The attendant would have to be in constant attendance to the feeder and would have to carefully lay the stock in a light shingle fashion. With the present device, the operator loads the magazine and the machine does the rest.

The lifting and lowering undulates the stock and functions to vibrate the entire stack and separates the items from each other by breaking the static friction therebetween so that the feed easier.

Having described a preferred embodiment of the invention, it will be apparent the various modifications will now be readily realized to those skilled in the art which are intended to be covered by the appended claims.

I claim:

1. In a conveyor for feeding stock items to associated mechanism, means for storing said stock items in a stack, means for feeding said items to the associated mechanism from said storing means including means for sequentially delivering to said mechanism said items one by one off the bottom of the stack during predetermined intervals, and means intervening said intervals for lifting the entire stack off said feeding means and comprising means for thereupon facilitating pullout of the bottom item by said mechanism, said means for feeding said items comprising rotatable means disposing beneath the stack and having slick areas and high frictional areas circumferentially offset from each other, said slick areas projecting farther from the axis of rotation of said rotatable means than said frictional areas and being operative to engage and lift the stack and provide a slide surface for the bottom item during said interval and said frictional areas operative to advance the succeeding bottom article a predetermined distance from under the stack into said mechanism after the previous bottom item has been completely withdrawn by said mechanism from under the stack by engaging such succeeding article attendant to the stack being lowered upon the respective frictional area.

2. The invention according to claim 1 and said feeding means comprising a roller assembly having agressive delivery sectors and intervening nonagressive lifting dectors, said delivery sectors formed and arranged to engage the lowermost item during said intervals and at least partially withdraw it from beneath the stack, and nonagressive sectors operative to engage the partially withdrawn item to facilitate its complete removal by said mechanism.

3. The invention according to claim 1 and said feeding means comprising a roller assembly rotatably supported beneath the stack and having a first sector providing a high coefficient of friction and positioned during said interval in abrading relation to the lowermost item for partially shifting it from under the stack, and said lifting means comprising a second section formed as a ramp movable under the stack and engageable with said partially shifted lowermost item and having a relatively low coefficient of friction to provide slippage means for the partially shifted item for accommodating easy further removal thereof.

4. The invention according to claim 3 and said first sector being flexible and deflectible by said stack resting thereupon and said second sector being relative inflexible and providing a smooth surface supporting the stack.

5. The invention according to claim 4 and said sectors being displaced from each other circumferentially of the roller.

6. The invention according to claim 1 and said stock items having leading and trailing ends, means comprising a retard assembly positioned in intercepting relation to items being delivered by said conveying means and said retard assembly comprising a retard member and a feed roller associated therewith defining an intake nip for reception of the leading end of the lowermost item, and means for actuating said conveying means and feed roller during said interval for withdrawing said lowermost item by said feed roller from under the stack for delivery to associated pull means.

7. The invention according to claim 1 and said means for lifting operative to lower the stack onto said delivering section, and a further operative conveying assembly positioned beneath the stack and adapted to convey a batch of said items from the lower portion of the stack to a position directly over said lifting and deliverying means upon depletion of stock from such position.

8. Means for conveying stock items from the bottom of a heavy stack as a continuous stream of single items comprising:

a feeding system underposed with respect to said stack and having delivery means for periodically engaging the bottom item of the stack and partially removing the bottom item from the bottom of the stack and delivering it into associated item-grasping metering means, and means for lifting the entire stack off said delivery means and providing means facilitating complete withdrawal of the partially removed item and positioning the items in the stack above the partially removed item out of registry with said metering means.

9. The invention according to claim 8 and said delivery and lifting means comprising at least one roller assembly underposed with respect to the stack and rotatable about a generally horizontal axis, and said assembly comprising circumferentially displaced lifting and delivery portions.

10. The invention according to claim 9 and said lifting portions having curved slick item engaging surfaces with abruptly rising leading ends for sliding under the stack in tangential contact with the lowermost item, and said delivery portions having surfaces of relatively high coefficient of friction for obtaining an effective purchase with the item engaged thereby.

11. The invention according to claim 8 and said metering means being spaced laterally from the stack in receiving alignment with the path of discharge of the lowermost item, said delivery means and lifting means being consecutively operative and said delivery means having an operative span effective to enter the item engaged thereby into said metering means.

12. The invention according to claim 8 and said delivery means defining a conveying component and said lifting means defining an undulating component formed in an assembly rotatable beneath said stack and said delivery component comprising cylindrical roller sectors with flexible item-engaging ribs and said undulating component comprising slick-surfaced ramps on said assembly iterdigitated with said sectors.

13. The invention according to claim 8 and said stock items having leading and trailing ends, and said metering means comprising a retard and a feed roller therebeneath defining a metering nip, means for shifting a batch of the stock from the lower end of the stack toward said metering means and imbricately arranging the items of said batch with their leading ends positioned against said retard roller and the lowermost item extended forwardmost beneath said retard roller and entered into said nip.

14. The invention according to claim 13 and a pullout roller assembly downstream of said metering means for receiving an item passed through said metering means and operative upon reception of said item to withdraw the item entirely from under the stack irrespective of the position of the item on the lifting and delivery components.

15. A conveying system for feeding in sequence single article from the bottom of a plurality of articles arranged in a stack, means for withdrawing articles presented thereto from under the stack, dual means comprising conveying and lifting means disposed beneath the stack for respectively alternately conveying the bottom article from under the stack to said withdrawing means for grasping engagement thereby and then elevating the remainder of the stack to a nonconveying interim and disposing the remaining articles in a non-grasping position by said withdrawing means while accommodating withdrawal of the remainder of the grasped bottom article from under the stack by said withdrawing means, and said withdrawing means operative to withdraw the remainder of the article grasped thereby during said interim while the entire load of the remaider of the stack rests upon said lifting means with minimal friction.

16. The invention according to claim 15 and metering means interposed between said stack and said withdrawing means and comprising a retard and a feed wheel forming an intake nip for receiving one end of said partially withdrawn article and drawing the same therethrough, and said withdrawing means comprising a pullout assembly disposed to receive said one end of said partially withdrawn article from said metering means and operative to completely withdraw said last-mentioned article from under said stack and from said metering means.

17. The invention according to claim 16 and a supplementary conveyor upstream of said dual means for engagement with the bottom of the lowermost artice and operative to deliver batches of said articles from said stack to a position proximate to said metering means.

18. The invention according to claim 15 and means for actuating said dual means attendant to discharge of each article from said system.

19. The invention according to claim 15 and said dual means comprising a rotatable roller assembly having a lifting sector and a delivery sector arranged in stepped relation to the lifting sector.

20. The invention according to claim 16 and other conveying means upstream from the roller assembly and operative therewith and underposed with respect to the stack for engagement with the bottom article of the batch deposited thereon.

* * * * *